US010946608B2

(12) United States Patent
Sahin et al.

(10) Patent No.: US 10,946,608 B2
(45) Date of Patent: Mar. 16, 2021

(54) CORNET BENDING MACHINE WITH INDEPENDENT MOTION CONTROL SYSTEM FROM MECHANICS

(71) Applicant: MONDI AG, Kirklareli (TR)

(72) Inventors: Umit Sahin, Kirklareli (TR); Osman Kadiroglu, Kirklareli (TR)

( * ) Notice: Subject to any disclaimer, the term of this patent is extended or adjusted under 35 U.S.C. 154(b) by 0 days.

(21) Appl. No.: 16/494,475

(22) PCT Filed: Nov. 8, 2017

(86) PCT No.: PCT/TR2017/050556
§ 371 (c)(1),
(2) Date: Sep. 16, 2019

(87) PCT Pub. No.: WO2018/226182
PCT Pub. Date: Dec. 13, 2018

(65) Prior Publication Data

US 2020/0016861 A1 Jan. 16, 2020

(30) Foreign Application Priority Data

Jun. 6, 2017 (TR) ..... 2017/08349

(51) Int. Cl.
*B31B 50/34* (2017.01)
*B31F 7/02* (2006.01)
(Continued)

(52) U.S. Cl.
CPC ..... *B31F 7/02* (2013.01); *B31B 50/34* (2017.08); *B31B 70/30* (2017.08); *B31F 7/004* (2013.01);
(Continued)

(58) Field of Classification Search
CPC ..... B31B 70/26; B31B 70/28; B31B 70/30; B31B 50/26; B31B 50/28; B31B 50/30; B31B 50/32; B31B 50/322; B31B 50/324; B31B 50/326; B31B 50/34; B31F 7/002; B31F 7/004
See application file for complete search history.

(56) References Cited

U.S. PATENT DOCUMENTS 2,240,501 A 5/1941 Greenhill
6,200,406 B1 * 3/2001 Ito ..... B31B 50/00 156/250
6,514,185 B1 * 2/2003 Knuppertz ..... B31B 50/00 493/295

FOREIGN PATENT DOCUMENTS

TR 2006/01473 U 3/2006
TR 2015/12633 U 10/2015

OTHER PUBLICATIONS

Written Opinion of the ISA for PCT/TR2017/050556.

* cited by examiner

*Primary Examiner* — Chelsea E Stinson
(74) *Attorney, Agent, or Firm* — Egbert Law Offices, PLLC

(57) ABSTRACT

A high-speed cornet bending machine with high production capacity and mechanically independent motion control system is provided. At least one feeding device is provided for transferring the sheets in order to the conveying device. Feeding device motors are provided for driving the feeding device. Conveying devices include a transfer line for transferring the sheets from the transport apparatus to the end bending unit as standard and end bending units for standard bending the product ends into a high production capacity and mechanically independent movement control system.

9 Claims, 2 Drawing Sheets

(51) Int. Cl.

| | |
|---|---|
| ***B31B 70/26*** | (2017.01) |
| ***B31F 7/00*** | (2006.01) |
| *B31B 110/10* | (2017.01) |
| *B31B 160/30* | (2017.01) |

(52) U.S. Cl.
CPC ..... *B31B 2110/10* (2017.08); *B31B 2160/30* (2017.08)

CORNET BENDING MACHINE WITH INDEPENDENT MOTION CONTROL SYSTEM FROM MECHANICS

TECHNICAL FIELD

The invention relates to a high-speed cornet bending machine with high production capacity and mechanically independent motion control system.

KNOWN STATUS OF TECHNIQUE

Cornet bending machines known in the art generally operate mechanically. The motion control systems of these machines are mechanically designed. Since these machines are operated entirely with gears and transmission systems, mechanical failures frequently occur. Another drawback of conventional cornet bending machines is that they have very low manufacturing speeds. For this reason, labor costs are quite high.

In the patent search of the prior art, a useful model with reference number 2015/12633 of classification class B31F 7/00 was found. This application is concerned with novelty in paper folding apparatus which is developed in order to make paper insertion and curling process easier in paper folding art (Quilling) and advantageous because of its short end and long end curvature and its risk free structure especially suitable for children's use.

Another application of the prior art is the utility model 2006/01473 of class A 24 C 5/47, A crimping device for a filter accessory includes at least one blade-like member that contacts the material in a specific contact area so as to deform a continuous strip of paper material as it travels so that the crimping unit of the accessory imparts a crimped profile to the single end wrapping paper separated from the strip And as a result, when combined they wrap and combine the combined filter and cigarette rods more easily; The curling device further comprises a delivery system for delivering a cushioning fluid to the contact area designed to provide a smooth sliding contact between the crimping element and the advancing strip and also to equalize the tension of the strip in front of and in the region following the contact area.

As a result, there is a need to develop new high-speed cornet bending machines with high production capacity and mechanically independent motion control systems, which will overcome the disadvantages mentioned above and solve the existing systems.

PURPOSE OF THE INVENTION

The present invention relates to a high-speed cornet bending machine with high production capacity and mechanically independent motion control system.

The primary object of the invention is; To increase production speeds.

One aim of the invention is to reduce maintenance costs.

Another object of the invention is to reduce unit labor costs.

One object of the invention is to prevent mechanical failures.

Another object of the invention is prevention of work accidents.

One of the objects of the invention is to provide a business change advantage in a short time.

FIGURES TO HELP THE COMPREHENSION OF INVENTION

EXPLANATION OF PART REFERENCES

Figure 1:
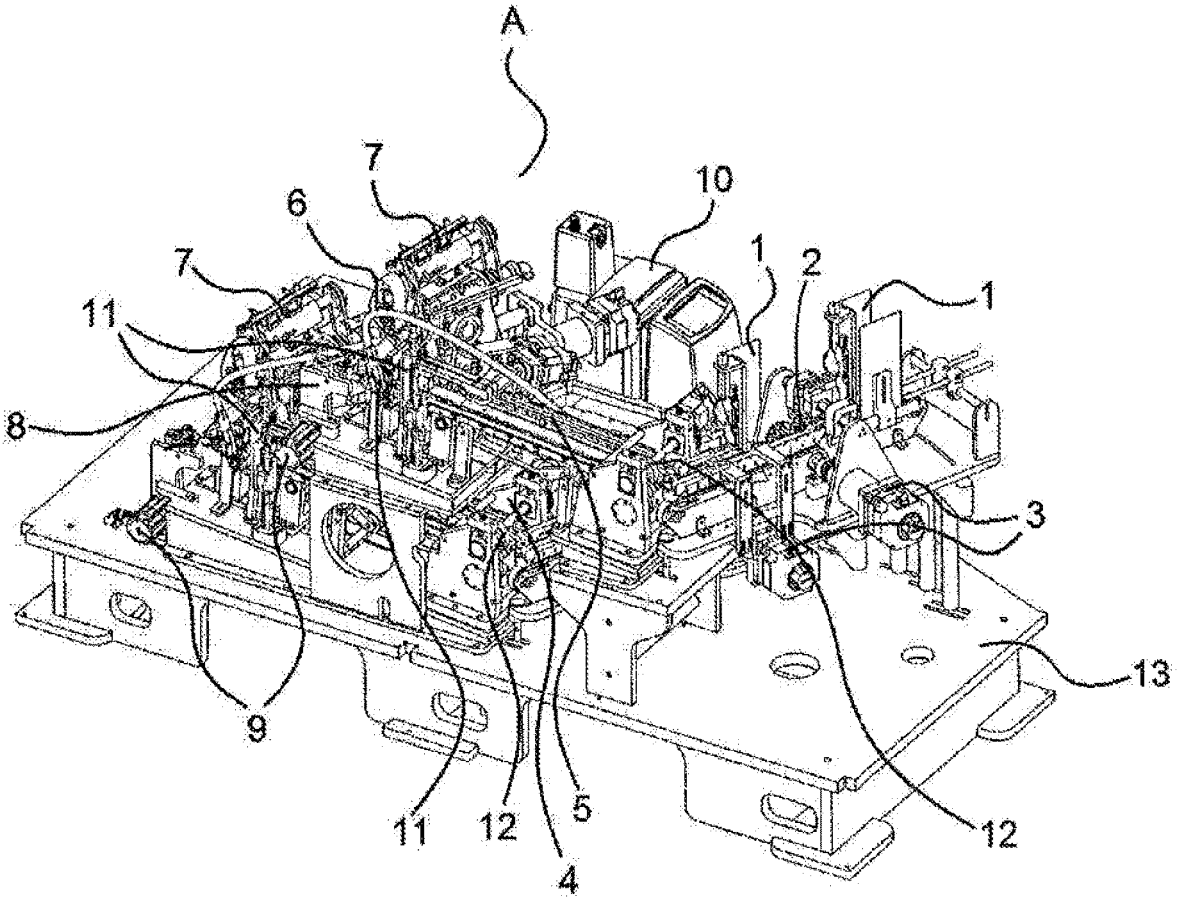
FIG. 1 is a perspective view showing the inventive cornfolder.

A. Cornet bending machine
1. Feeding magazine
2. Transmission apparatus
3. Feeding apparatus engines
4. Sliding equipment
5. Transfer line
6. Chopping knife
7. Knife sliding device
8. Tip bending unit
  8.1. Upper bending conical mold
  8.2. Lower bending conical mold
  8.3. Upper bending drive motor
  8.4. Lower bending drive motor
  8.5. On/Off engine
9. Tip bending engines
10. Glue tank
11. Glue injectors
12. Semilunar reel
13. Main body
14. Feeding sensors
15. Paper transfer unit
  15.1. Carrier feet
16. Chip suction unit

DETAILED DESCRIPTION OF THE INVENTION

The invention relates to a high-speed cornet bending machine (A) with high production capacity and mechanically independent motion control system.

As shown in FIG. 1, the bending machine (A) according to the invention comprises a main body (13) which carries the elements forming the bending machine (A). On the main body (13), there is at least one feeding magazine (1) which sequentially transfers the papers to the conveying apparatus (2). The driving movement of said feeding magazine (1) is provided by the feeder motors (3). In front of the feeding magazine (1), the conveying belt (2) which is conveyed from the feeding apparatus (1) to the transfer line (5) is positioned. Said transfer line (5) transfers the papers from the transport apparatus (2) to the end bending unit (8) as standard. The sliding device 4 transfers the papers from the feeding magazine 1 to the transport apparatuses 2.

As seen in FIG. 1, the cornet bending machine A according to the invention comprises at least one saw blade 6 which cuts off the excess pieces on the paper going from the transfer line 5 to the end curling unit 8. When the cornet bending machine (A) stops next to the saw blade (6), the operator cuts the saw blade (6) from the end bending unit (8) at least one blade swivel (7) for preventing accidents is located.

As shown in FIG. 1, the cornet bender (A) according to the invention comprises a tip crimp unit (8) which allows the product ends to be crimped in a standard manner. On the sides of the end bending unit (8) are end bending motors (9) which allow the end bending unit (8) of the paper to enter smoothly.

Figure 2:
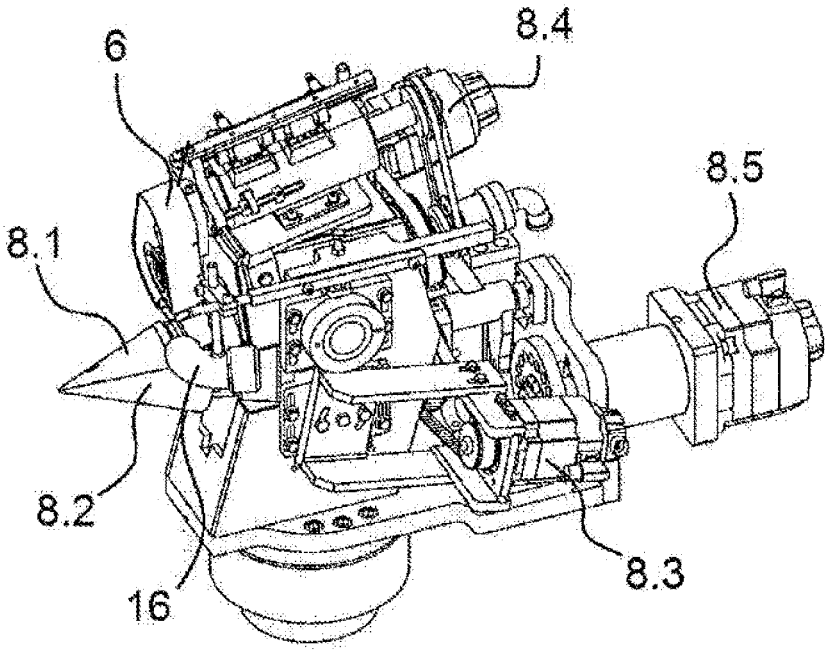
FIG. 2 is a perspective view showing the tip bending unit.
Figure 3:
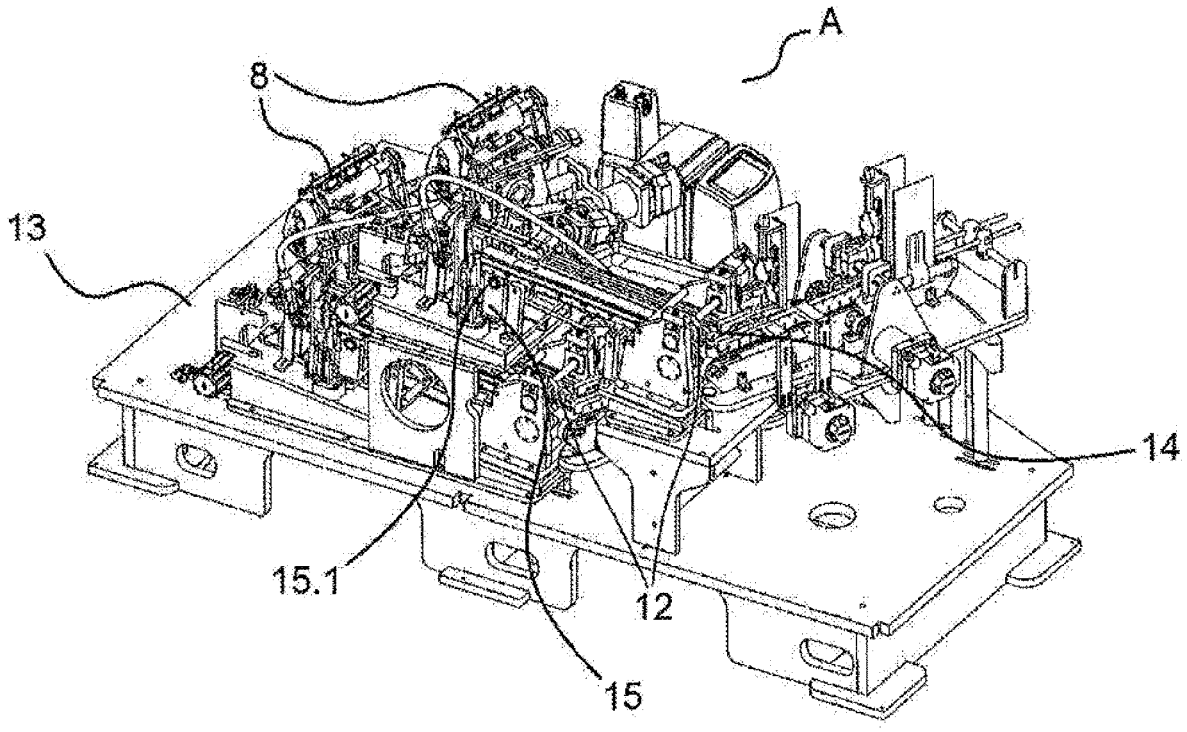
FIG. 3 is a perspective view showing the feed sensors and the paper transfer unit.

As shown in FIG. 2, said end bending unit 8 is provided with an upper bending conical mold 8.1 for providing vacuum removal of the sheets from the transfer line 5 and an upper bending bushing mold 8 located under the upper bending conical mold 8.1, (8.2) which folds the paper together with the upper bending conical mold (8.1). The upper bending conical mold (8.1) gives the drive action the upper bending drive motor (8.3). The lower bending conical mold (8.2) gives the drive motion to the lower bending drive motor (8.4). Behind the upper curving conical mold (8.1) is the opening and closing motor (8.5) which allows the upper curving conical mold (8.1) to open and close. Beneath the chip blade (6), a chip suction unit (16) is located which allows the excess chips cut by the chip knife (6) to be sucked and discharged from the medium.

As shown in FIG. 1, the cornet bending machine subject to intervention (A) comprises a glue tank (10) which provides adhesion of the molten glue product. The glue injectors (11) allow the glue coming from the glue tank (10) to be driven onto the paper. Semi lunar reels (12) allow the sheets coming from the feeding magazine (1) to be driven to the transfer line (5).

As shown in FIG. 1, the cornet bender A according to the invention includes feed sensors 14 for starting the feed by sensing the position of the semi lunar reel 12 relative to the product and signaling the appropriate position. The paper transfer unit 15 located on the main body 13 transfers the paper from the transfer line 4 to the end bending unit by equally spacing the paper at a certain distance. The carrier feet (15.1) on the paper transfer unit (15) ensure that the papers are evenly spaced at a certain distance. The paper transfer unit (15) is positioned at an angle of at least 1 degree relative to the floor. In this way, the climbing motion is given to the products and the product transfer is carried out at higher speeds by preventing the undesired movement of the positioned products.

In accordance with the above information, the coating machine (A) according to the present invention operates in the following manner.

As shown in FIG. 1, the loading operation is carried out by the operator to the conveying apparatus 2 in such a manner that the cornet papers in the semi-finished state of the feed magazine 1 are overlaid. The products from the conveying apparatus 2 are removed one by one and conveyed in the fastest manner to the feed sensors 14 by means of the conveyor apparatus 4 on the feeding magazine 1 and held until the appropriate time information from the feed sensor 14 is received. When appropriate information is received, the product is transferred to the feed sensor (14). The semi lunar reel (12) on the transfer line (5) specified as the appropriate time information is the position relative to the product. Products are transferred to the paper transfer unit (15) by the semi lunar reel (12). The carrier feet (15.1) on the paper transfer unit (15) start conveying the products at a certain distance to the end bending unit (8) by aligning the end bending unit (8) During this transfer process, the products are positioned relative to the transfer line (5) with the upper curling conical mold (8.1) and the lower curling conical mold (8.2).

Gluing is carried out with the glue injector (11) in the interior of the products with the desired properties immediately before entering the end bending unit (8) in the products positioned and located in the vicinity of the end bending unit (8). Then the products coming in front of the end bending unit 8 are vacuumed by the upper bending conical mold 8.1 and the products received on the paper transfer unit 15 are compressed with the lower bending conical die 8.2 and bended at the same time by bending. During this bending operation, the upper overrunning drive motor (8.3) is provided. The lower bending conical mold (8.2) gives the drive motion to the lower bending drive motor (8.4). During this bending process, the excess chips formed in the mouth portion of the product are cut with the saw blade (6) rotating on the upper bending conical mold (8.1). Cut chips are sucked out by the chip suction unit (16). After the bending process and the chip cutting process are completed, the lower bending conical mold (8.2) is opened by the opening/closing motor (8.5) and the upper bending conical mold (8.1) In this way the production cycle is repeated continuously. The products are collected manually by the operator in the collection chamber.

In the cornet bending machine (A) of the invention, there are preferably two end bending units (8). In this way, the production speed is increased. The end bending units (8) on the cornet bending machine (A) operate independently of each other. In an alternative embodiment of the invention, the cornet bending machine (A) may have one or more multi-end bending units (8).

The invention claimed is:

1. A cornet bending apparatus comprising:

at least one feeding magazine that sequentially feeds a paper to a conveying apparatus;

a plurality of feeder motors cooperative with said at least one feeding magazine so as to drive said at least one feeding magazine, wherein the conveying apparatus is cooperative with said at least one feeding magazine so as to feed the paper from said at least one feeding magazine to a transfer line, the transfer line positioned at an angle of at least one degree relative to horizontal;

an end bending unit cooperative with the transfer line such that the paper on the transfer line is transferred to said end bending unit, wherein said end bending unit bends the paper to a desired shape;

at least one saw blade upstream of said end bending unit and adapted to cut off excess material from the paper as the paper moves from the transfer line to said end bending unit; and a chip suction unit cooperative with said at least one saw blade and adapted to suction chips sawed from the paper by said at least one saw blade.

2. The comet bending apparatus of claim 1, wherein said end bending unit has a vacuum adapted to remove the paper by vacuum from the conveying apparatus.

3. The cornet bending apparatus of claim 1, wherein said end bending unit has an upper bending tapered die adapted to compress the paper.

4. The comet bending apparatus of claim 1, wherein said end bending unit has an upper bending conical mold that is driven by an upper bending drive motor.

5. The comet bending apparatus of claim 4, wherein the upper bending conical mold is openable and closable by the upper bending drive motor.

6. The cornet bending apparatus of claim 1, wherein said end bending unit has a lower bending conical mold driven by a lower bending drive motor.

7. The cornet bending apparatus of claim 1, further comprising:

a plurality of end bending motors cooperative with said end bending unit so as to allow the paper to enter said end bending unit from the conveying apparatus.

8. The comet bending apparatus of claim 1, further comprising:

at least one blade slip device cooperative with said at least one saw blade so as to remove said at least one saw blade from said end bending unit when the comet bending apparatus stops.

9. The comet bending apparatus of claim 1, further comprising:

a spool having feed sensors cooperative with said conveying apparatus so as to sense a position of the paper on said conveying apparatus, the feed sensors being positioned over the paper.

* * * * *